US008978758B2

(12) United States Patent
Ayasse

(10) Patent No.: US 8,978,758 B2
(45) Date of Patent: Mar. 17, 2015

(54) OIL RECOVERY PROCESS USING CROSSED HORTIZONAL WELLS

(75) Inventor: Conrad Ayasse, Calgary (CA)

(73) Assignee: Capri Petroleum Technologies Ltd., Calgary (CA)

( * ) Notice: Subject to any disclaimer, the term of this patent is extended or adjusted under 35 U.S.C. 154(b) by 412 days.

(21) Appl. No.: 13/314,008

(22) Filed: Dec. 7, 2011

(65) Prior Publication Data

US 2013/0146283 A1 Jun. 13, 2013

(30) Foreign Application Priority Data

Nov. 25, 2011 (CA) ..... 2759356
Nov. 25, 2011 (WO) ..... PCT/CA2011/001310

(51) Int. Cl.
*E21B 43/16* (2006.01)
*E21B 43/243* (2006.01)
*E21B 43/30* (2006.01)

(52) U.S. Cl.
CPC ..... *E21B 43/243* (2013.01); *E21B 43/166* (2013.01); *E21B 43/305* (2013.01)
USPC ..... 166/256

(58) Field of Classification Search
CPC ... E21B 43/2406; E21B 43/166; E21B 43/24; E21B 36/02; E21B 43/305; E21B 43/243
USPC ..... 166/256, 401, 302–304, 50, 52, 250.06, 166/266, 272.3
See application file for complete search history.

(56) References Cited

U.S. PATENT DOCUMENTS 6,412,557 B1 7/2002 Ayasse et al.
2005/0072567 A1* 4/2005 Steele et al. ..... 166/272.3
2010/0012331 A1* 1/2010 Larter et al. ..... 166/401
2011/0067858 A1 3/2011 Dreher et al.

FOREIGN PATENT DOCUMENTS

RU 2434129 C1 11/2011

* cited by examiner

*Primary Examiner* — Yong-Suk (Philip) Ro
(74) *Attorney, Agent, or Firm* — Gowling Lafleur Henderson LLP; D. Doak Horne

(57) ABSTRACT

A method of the simultaneous production of oil and combustion gases using gravity phase segregation and gravity drainage to produce hydrocarbons from a subterranean oil-bearing formation. Such method comprises initially injecting a fluid such as a solvent, steam, or an oxidizing gas through a pair of horizontal wells placed high in the formation and producing oil through a plurality of parallel lower horizontal wells situated low in the reservoir, each lower horizontal well perpendicularly disposed to said upper horizontal wells. In a preferred embodiment well liner segments are provided in lower horizontal wells, having apertures therein, to allow oil to flow into said lower horizontal wells. At locations where an upper horizontal well traverses a lower horizontal well such well liners possess no apertures thereby preventing oxidizing gas injected in said upper horizontal wells from flowing directly into said lower horizontal wells at such point at which said lower wells are traversed by said upper wells.

26 Claims, 6 Drawing Sheets

OIL RECOVERY PROCESS USING CROSSED HORTIZONAL WELLS

FIELD OF THE INVENTION

The present invention relates to an oil recovery process, and more particularly to a method of recovering oil from subterranean hydrocarbon deposits using horizontal crossed injector wells.

BACKGROUND OF THE INVENTION

There are many oil recovery processes of the prior art employed for the production of oil from subterranean reservoirs. Some of these use vertical wells or combine vertical and horizontal wells. Examples of pattern processes are the inverted 7-spot well pattern that has been employed for steam, solvent and combustion-based processes using vertical wells, and the staggered horizontal well pattern of U.S. Pat. No. 5,273,111 which has been employed (but limited to) a process using steam injection.

U.S. Pat. No. 5,626,191 discloses a repetitive method [now termed Toe-to-Heel Air Injection (THAI)] whereby the vertical segment of a vertical-horizontal producer well is subsequently converted to an air injection well, to assist in mobilizing oil for recovery by an adjacent horizontal well, which is subsequently likewise converted into an air injection well, and the process repeated.

U.S. Pat. No. 6,167,966 employs a water-flooding process employing a combination of vertical and horizontal wells.

U.S. Pat. No. 4,598,770 (Shu et al, 1986) discloses a steam-drive pattern process wherein alternating horizontal injection wells and horizontal production wells are all placed low in a reservoir. In situ combustion processes are not contemplated.

Joshi in Joshi, S. D., "A Review of Thermal oil Recovery Using Horizontal wells", In Situ, 11(2 &3), 211-259 (1987), discloses a steam-based oil recovery process using staggered and vertically-displaced horizontal injection and production wells pattern. A major concern is the high heat loss to the cap rock when steam is injected at the top of the reservoir.

U.S. Pat. No. 5,273,111 (Brannan et al, 1993) teaches a steam-based pattern process for the recovery of mobile oil in a petroleum reservoir. A pattern of parallel offset horizontal wells are employed with steam injectors. The horizontal sections of the injection wells are placed in the reservoir above the horizontal sections of the production wells, with a horizontal production well drilled into the reservoir at a point below the injection wells, but intermediate said injection wells. Steam is injected on a continuous basis through the upper injection wells, while oil is produced through the lower production wells. Neither in situ combustion nor line drive processes are taught.

U.S. Pat. No. 5,803,171 (McCaffery et al, 1998) teaches an improvement of the Brennan patent wherein cyclic steam stimulation is used to achieve communication between the injector and producer prior to the application of continuous steam injection. In situ combustion processes are not mentioned.

U.S. Pat. No. 7,717,175 (Chung et al, 2010) discloses a solvent-based process utilizing horizontal well patterns where parallel wells are placed alternately higher and lower in a reservoir with the upper wells used for production of solvent-thinned oil and the lower wells for solvent injection. Gravity-induced oil-solvent mixing is induced by the counter-current flow of oil and solvent. The wells are provided with flow control devices to achieve uniform injection and production profiles along the wellbores. The devices compensate for pressure drop along the wellbores which can cause non-uniform distribution of fluids within the wellbore and reduce reservoir sweep efficiency. In situ combustion processes are not mentioned.

WO/2009/090477 (Xia et al) discloses an in situ combustion pattern process wherein a series of vertical wells that are completed at the top are placed between horizontal producing wells that are specifically above an aquifer. This arrangement of wells is claimed to be utilizable for oil production in the presence of an aquifer.

US Patent Application 2010/0326656 (Menard, 2010) discloses a steam pattern process entailing the use of alternating horizontal injection and production wells wherein isolated zones of fluid egress and ingress are created along the respective wellbores in order to achieve homogeneous reservoir sweep. The alternating wellbores may be in the same vertical plane or alternating between low and high in the reservoir, as in U.S. Pat. No. 5,803,171. Hot vapour is injected in the upper wells (e.g. steam).

Canadian Patent Application 2,698,454 (Ayasse) teaches a combustion process in which a horizontal oxidizing gas injection well is placed high in the reservoir directly above an oil producing horizontal well placed low in the reservoir. After ignition, the combustion front grows laterally from the injector with oil and combustion gas draining into the lower producing well placed low in the reservoir. The overall field development is by the sequential placement of injector-producer well pairs in a pattern.

As seen from the above patents, steam-based oil recovery processes are commonly employed to recover heavy oil and bitumen from underground formations. For example, steam-assisted-gravity-drainage (SAGD) and cyclic steam injection are used for the recovery of heavy oil and cold bitumen. When the oil is mobile as native oil or is rendered mobile by some in situ pre-treatment, such as a steam drive process, the thus-mobilized oil can then drain downwardly by gravity and be collected by a horizontal collector well.

A serious drawback of steam drive processes is the inefficiency of generating steam at the surface because a considerable amount of the heat generated by the fuel is lost without providing useful heat in the reservoir. Roger Butler, in his book "Thermal Recovery of oil and Bitumen', p. 415, 416, estimates the thermal efficiency at each stage of the steam-injection process as follows: steam generator, 75-85%; transmission to the well, 75-95%' flow down the well to the reservoir, 80-95%; flow in the reservoir to the condensation front, 25-75%. It is necessary to keep the reservoir between the injector and the advancing condensation front at steam temperature so that the major energy transfer can occur from steam condensing at the oil face. In conclusion, 50% or more of the fuel energy can be lost before heat arrives at the oil face. The energy costs based on BTU in the reservoir are 2.6-4.4 times lower for air injection compared with steam injection. Several other drawbacks occur with steam-based oil recovery processes: natural gas may not be available to fire the steam boilers, fresh water may be scarce and clean-up of produced water for recycling to the boilers is expensive. In summary, steam-based oil recovery processes are thermally inefficient, expensive and environmentally unfriendly.

Improved efficiency, shortened time on initial return on investment (ie quicker initial oil recovery rates to allow more immediate return on capital invested), and decreased initial capital cost, in various degrees, are each areas in the above methods which may be improved.

SUMMARY OF THE INVENTION

The present invention, in one embodiment using in situ combustion, avoids the necessity of having to generate large quantities of steam, typically under high pressure, and inject such steam in a formation, such as in the prior art method of Brannan discussed above, which method has the drawbacks of needing to provide large and costly steam-generating equipment at surface, and as noted above is thermally inefficient in transferring heat to oil within the reservoir in order to achieve the necessary reduction in viscosity to be able to produce oil from a viscous oil reservoir. The present method thus avoids the capital costs of acquiring, shipping, and assembling the necessary steam generating equipment in the form of boilers, burners, and associated piping.

In addition, the "crossed-wells" method of the present invention, at least for the model test dimensions of hydrocarbon reservoir used in the Examples herein (see below), has a greater initial oil recovery factor than one of the configurations disclosed in Canadian Patent 2,698,454 commonly assigned to the applicant herein, namely a configuration wherein pairs of upper and lower horizontal wells are parallel to and vertically spaced apart from each other, with the lower horizontal well positioned immediately beneath the corresponding upper horizontal well of a lower and upper well pair, and the well pairs are all parallel to one another.

Specifically, for a comparable volumetric sweep area and identical total cumulative oil recovery over a 3 year period in regard to a subterranean underground reservoir (formation), the crossed-wells method of the present invention has been experimentally shown, under certain conditions as discussed herein, to provide a greater initial rate of recovery of oil than one of the embodiments of the method disclosed in CA 2,698,454, thus allowing for a more rapid initial return on investment.

For oil companies incurring large expenditures in developing subterranean reservoirs, the ability to utilize a method of oil recovery which will generate revenue quickly and thereby permit quicker "pay-down" of initial expenses incurred with regard to search, locating, and acquiring, and initially drilling wells in a hydrocarbon-bearing formation is a significant advantage. The time in which a return on investment may be realized is frequently a very real and substantial consideration as to whether the investment in such a capital project is or can ever be made in the first place.

Accordingly, in one broad embodiment of the oil recovery process of the present invention, such method comprises a continuous fluid injection process using solely a horizontal well or wells for injection of said fluid, and using horizontal wells for the simultaneous production of oil, using one or more upper horizontal injection wells, each parallel to one another, and a plurality of lower horizontal production wells spaced vertically below said upper horizontal wells, each of said lower horizontal wells likewise parallel to one another but each perpendicularly disposed to the upper horizontal wells.

More particularly, in one broad embodiment, the method of the present invention comprises a method for recovering oil from a hydrocarbon-containing subterranean reservoir, comprising the steps of:

(i) drilling at least one upper horizontal injection well within an upper region of said hydrocarbon-containing reservoir and substantially within a horizontal plane therein;

(ii) drilling, relatively low in said reservoir, a plurality of parallel lower horizontal producer wells, situated low in said hydrocarbon containing reservoir below said at least one upper horizontal well and positioned substantially parallel to each other but perpendicular to said upper well(s);

(iii) injecting a fluid into said upper horizontal well and injecting said fluid into said reservoir via apertures in said upper horizontal well;

(v) recovering oil which has been caused to migrate downwardly in said subterranean reservoir, via said lower horizontal wells; and (vi) recovering said oil from said lower horizontal wells to surface.

The downward migration of oil in the formation can be enhanced, or caused to flow downwardly, by pressure drawdown from the lower horizontal wells, thereby causing oil in the formation to flow to a region on the formation of low pressure, namely areas surrounding the lower horizontal wells, and to thereby be recovered into and by such lower horizontal wells.

The injected fluid may be carbon dioxide or a hydrocarbon diluent, which may be injected as a gaseous solvent in this oil recovery process to cause oil in the formation/reservoir when made less viscous due to such carbon dioxide or hydrocarbon diluent, to drain downwardly and thereafter be collected by the crossed lower horizontal wells, by gravity drainage and/or pressure drawdown. In an alternative embodiment, a thermal process may be conducted, such as by injecting steam to heat the oil in the formation, or by injecting an oxidizing gas to support in situ combustion, so as to by such heating of oil in the formation likewise decrease the viscosity of the oil in the formation and cause the oil to drain downwardly for subsequent collection by the lower horizontal production wells. Combinations of oxidizing gas, heating gas and solvent gas may also be used.

In a particular embodiment, in situ combustion of a portion of the oil in the hydrocarbon formation may be carried out, so as to thereby heat remaining oil in the formation, and likewise thereby decrease its viscosity and cause such heated oil, now made mobile (or more mobile) to drain downwardly under the effect of gravity and/or pressure drawdown in the lower horizontal wells, for subsequent collection by the lower horizontal collection wells.

Accordingly, a particular embodiment, such method comprises an in situ combustion method for recovering oil from a hydrocarbon-containing subterranean reservoir, comprising the steps of:

(i) drilling at least one upper horizontal well within an upper region of said hydrocarbon-containing reservoir and substantially within a horizontal plane therein;

(ii) drilling, relatively low in said reservoir, a plurality of parallel lower horizontal wells, situated low in said hydrocarbon containing reservoir below said upper horizontal well and positioned substantially parallel to each other but perpendicular to said upper well;

(iii) injecting a fluid into each of said upper horizontal well and injecting said fluid into said reservoir via apertures in said upper horizontal well;

(v) recovering oil which has been caused to migrate downwardly in said subterranean reservoir, via said lower horizontal wells; and (vi) recovering said oil from said lower horizontal wells to surface.

In a preferred embodiment, a plurality of upper injection wells, namely at least two injection wells, are employed.

Accordingly, in such further embodiment, the method of the present invention comprises a method for recovering oil from a hydrocarbon-containing subterranean reservoir, comprising the steps of:

(i) drilling a pair of parallel, spaced-apart, upper horizontal wells within an upper region of said hydrocarbon-containing reservoir, each upper horizontal well substantially within a horizontal plane extending through an upper region of said reservoir;

(ii) drilling, relatively low in said reservoir, a plurality of parallel lower horizontal wells, situated low in said hydrocarbon-containing reservoir below said upper horizontal wells and positioned substantially parallel to each other but perpendicular to said upper wells;

(iii) injecting an oxidizing gas into each of said upper horizontal wells and injecting said oxidizing gas into said reservoir via apertures in each of said pair of upper horizontal wells;

(iv) combusting said oxidizing gas within said formation and causing oil in said formation to become heated;

(v) recovering oil which has become heated and which has migrated downwardly in said subterranean reservoir, via said lower horizontal wells; and (vi) recovering said oil from said lower horizontal wells to surface.

Such in situ method meets the commercial need of having relatively low energy costs (in that a separate supply of fuel for boilers to generate steam is not needed), and has lower initial capital start-up costs due to lack of need to acquire steam-generating equipment. Moreover, as further discussed below, such method for recovering hydrocarbons from a subterranean formation has a high initial oil recovery rate as compared to at least some alternative methods of recovery, for the dimensions of reservoir utilized in the examples below, such being a significant advantage in allowing income generated from the produced oil to be more quickly applied against the significant expenses of locating, acquiring, and developing a suitable hydrocarbon containing deposit.

In a preferred embodiment, the lateral placement of the upper horizontal wells from a vertical side of a rectangular area of said reservoir containing the upper injector wells and lower production wells is determined by a particular formula, to achieve appropriate and optimum symmetric position for the injection wells.

Accordingly, in said preferred embodiment wherein the reservoir has a width "W" and a number of upper horizontal injector wells "n" spaced along said width "W", each of said upper injector wells are laterally spaced a distance "D" along said width from a vertical side of a rectangular area of said reservoir containing said upper injector wells and lower horizontal production wells, with each of said upper injection wells being designated with a successive well number "wn" progressing from said vertical side, wherein the distance "D" of each progressively numbered upper injection wells wn from said vertical side is determined by the formula $D=W*[2*wn-1]/2n$.

In a further preferred method of the present invention, such method includes means to prevent the tendency of injected fluid to "short circuit" and travel the path of least resistance (ie shortest distance), namely travelling vertically directly downwardly from an injection well directly to the lower production wells at locations of crossing of the upper horizontal well(s) with the lower production wells, which "short circuiting" reduces and lessens the injection fluid which would otherwise contact oil elsewhere in the formation. Moreover, and in particular where in situ combustion is employed and an oxidizing gas is used as the injected fluid, "short circuiting" of the injected oxidizing gas by travelling directly downwardly from an upper horizontal well to a lower perpendicular production well can have the disastrous consequence of oxygen gas entering the production well(s) and contacting oil and hydrocarbon vapours being collected therein, with a resulting high risk of explosion which could potentially destroy the production well and damage the remainder of the formation.

Accordingly, in a preferred embodiment of the invention, to avoid such a detrimental result, such method may comprise the further step, prior to step (v) above, of:

(a) introducing well liner means within said lower horizontal wells, said well liner means having apertures therein to allow ingress of oil into said lower horizontal wells, said well liner means at a location in each of said lower horizontal wells directly below a point or points at which an upper vertical well traverses said lower horizontal well not having any apertures therein proximate said point(s) of traverse.

Alternatively in an alternative preferred embodiment of the invention, such method may alternatively (or additionally) comprise the further step, prior to step (v) above, of:

(a) introducing well liner means within said upper horizontal well(s), said well liner means having apertures therein to allow egress of the into the reservoir, said well liner means at a location in each of said upper horizontal wells directly above a point or points at which an upper vertical well traverses said lower horizontal wells not having any apertures therein proximate said point(s) of traverse.

Alternatively, to accomplish the same result of preventing fluid from directly "short circuiting" from an upper well into a lower crossed production well, instead of the well liner in a respective upper well or lower well at a point of traverse simply not having any apertures therein at a point of traverse of the upper injection well(s) with the lower perpendicular productions wells, such well liner may still possess apertures therein, one or more cylindrical members of a finite length having no apertures in a circumference thereof is/are inserted in either the upper well(s) or lower wells, at various locations along said upper or lower wells where the upper well(s) traverse the lower wells, to thereby block such apertures at such location and thereby block such direct route of travel by the injected fluid from the upper injection well directly downwards and into the lower production well via apertures in such well liner means at such point(s) of traverse.

Accordingly, in a preferred embodiment the method of the present invention comprises an in situ combustion method for recovering oil from a hydrocarbon-containing subterranean reservoir, comprising the steps of:

(i) drilling a least one upper horizontal well within an upper region of said hydrocarbon-containing reservoir and each substantially within a horizontal plane therein;

(ii) drilling, relatively low in said reservoir, a plurality of parallel lower horizontal wells, situated low in said hydrocarbon-containing reservoir below said upper horizontal wells and positioned substantially parallel to each other but perpendicular to said upper wells;

(iii) one, or both of said lower horizontal wells and/or said upper horizontal wells having fluid escape prevention means preventing direct transmission of injected fluid into said lower horizontal wells, at locations of traverse of said lower horizontal wells by said upper horizontal well(s).

Such preferred method is preferred particularly in instances where the vertical distance separating the upper horizontal wells from the lower crossed horizontal wells is 20 m or less, and/or the rate of injection of oxidizing gas is equal or greater than 200,000 m3/day, and/or oxidizing gas is the gas being injected.

Accordingly, in a preferred embodiment the method of the present invention comprises a method for recovering oil from a hydrocarbon-containing subterranean reservoir, comprising the steps of:

(i) drilling a least one upper horizontal well within an upper region of said hydrocarbon-containing reservoir;

(ii) drilling, relatively low in said reservoir, a plurality of parallel lower horizontal wells, situated low in said hydrocarbon-containing reservoir below said upper horizontal wells and positioned substantially parallel to each other but perpendicular to said upper wells;

(iii) one, or both of said lower horizontal wells and/or said upper horizontal well(s) having fluid escape prevention means preventing direct transmission of injected fluid into said lower horizontal wells, at locations of traverse of said lower horizontal wells by said upper horizontal well(s);

(iv) injecting a fluid into said upper horizontal well and injecting said fluid into said reservoir via apertures in said upper horizontal well(s);

(v) recovering oil which has migrated downwardly in said subterranean reservoir, via said lower horizontal wells; and (vi) recovering said oil from said lower horizontal wells to surface.

Accordingly, in a further particular embodiment of the method of the present invention, such method comprises an in situ combustion method of recovering oil from within a subterranean hydrocarbon-containing formation, comprising the steps of:

(i) drilling a plurality of parallel, laterally-spaced apart upper horizontal wells within an upper region of said hydrocarbon-containing reservoir and each substantially within a horizontal plane therein;

(ii) drilling, relatively low in said reservoir, a plurality of parallel lower horizontal wells, situated low in said hydrocarbon-containing reservoir below said upper horizontal wells and positioned substantially parallel to each other but perpendicular to said upper wells;

(iii) one, or both of said lower horizontal wells and/or said upper horizontal wells having fluid escape prevention means, at locations of traverse of said lower horizontal wells by said upper horizontal well(s), preventing direct travel of injected fluid from said upper injection wells into said lower horizontal wells;

(iv) injecting an oxidizing gas into said upper horizontal well and injecting said oxidizing gas fluid into said reservoir via apertures in said upper horizontal well(s);

(v) combusting said oxidizing gas and causing oil within said reservoir to become heated;

(vi) recovering oil which has become heated and which has migrated downwardly in said subterranean reservoir, via said lower horizontal wells; and (vii) recovering said oil from said lower horizontal wells to surface.

The process of the present invention can be applied to reservoirs with mobile oil or even immobile oil, such as bitumen reservoirs. In the case of immobile oil, the reservoir is first treated with solvent or heat to reduce the oil viscosity and attain oil mobility. In a preferred embodiment, the process of the present invention can be applied directly to a reservoir containing mobile oil so that pre-treatment is not required to establish communication between the injectors and producers. In the most preferred embodiment, as explained above, the well liner segments of the production wells directly below the injection wells are not perforated (ie contain no apertures at certain locations therein). Those are the first points at which the injected oxidizing gas will short-circuit into the production wells if the gas injection rate is too high and by placing blank well liner segments there, the gas injection rate can be safely increased, giving rise to higher oil production rates. The length of the blank segments is between 5 and 20 meters and preferably between 10 and 15 meters. In an oilfield operation, the transmissibility of well liners can easily be accomplished by varying the slot density of slotted liner segments (or "joints"), or the screen plug density of Facsrite[1] production well liners, or by other methods known to those skilled in well completion design.

The well liner means typically comprises well liner segments, which as noted above, generally contain apertures therein, but in respect of the well liner segments contained in the horizontal wells at locations where an upper horizontal well traverses a lower well, do not possess such apertures and are impervious so as to assist in preventing oil and oxidizing gas from entering the lower horizontal well directly via such location immediately beneath and upper injection well.

The outside diameter of the horizontal well liner segments can be 4 inches to 12 inches, but preferably 5-10 inches and most preferably 7-9 inches. The perforations in the horizontal well segments, for both the upper injection wells and the lower production wells, can be slots, wire-wrapped screens, Facsrite™ screen plugs or other technologies that provide the desired degree of sand retention yet allow ingress of oil, or in the case of well liner segments positioned in the horizontal upper wells, allow egress of oxidizing gas into the reservoir.

The injected gas injected into the formation via the upper horizontal wells and apertures in well liner segment in such upper horizontal wells may be any oxidizing gas, including but not limited to, air, oxygen or mixtures thereof. In a preferred embodiment the oxidizing gas is air but is further diluted with varying quantities of a non-oxidizing gas such as carbon dioxide, to thereby regulate (per injected volume) the relative concentration of oxygen in such quantity of injected gas, thereby allowing variable control over the temperature produced during combustion by decreasing or increasing the amount of oxygen injected and which is thereby allowed to combust with hydrocarbon within the formation.

Alternatively, or in addition, such oxidizing gas may further comprise variable quantities of steam, which may be used in a similar fashion to regulate the amount of oxygen in an injected volume of gas, or may be injected for the sole (or additional) purpose of allowing such steam to condense when moving downwardly in the formation and thereby release heat in the latent heat of condensation, thereby assisting in transferring heat to oil in the lower portion of the formation and allowing such oil to become mobile and drain downwardly into the lower horizontal collector wells.

Alternatively, or in addition, such oxidizing gas may further comprise a solvent gas, such as a hydrocarbon vapour or carbon dioxide, both of which act as a diluent to reduce the viscosity of the oil in the formation.

The maximum oxidizing gas injection rate will be limited by the maximum gas injection pressure which must be kept below the rock fracture pressure, and will be affected by the length of the horizontal wells, the reservoir rock permeability, fluid saturations and other factors.

The production mechanism is a combination of pressure drive and gravity drainage. Water, oil and production gas are typically co-produced. Production and injection well lengths can vary from 50 meters to 1500 meters or longer. Production well lateral spacings will depend on the mobility of the reservoir oil and will typically range from 50 m to 200 m or longer. The injection well length will be sufficient to span the production wells and extend in a direction perpendicular to the production wells. The injection and production wells may be perforated in a homogeneous manner along their lengths. In a preferred embodiment, the production wells are perforated according to a pattern so as to maintain equalized fluid transmissibility of fluids into the well, using processes and equipment well known to persons skilled in the art. For example, the frequency of perforations may be lowered near the heel of a producer where a pump is placed so that region of the wellbore will not receive excessive fluid from the reservoir and act like a thief zone.

While the in situ combustion process is emphasized above, in another embodiment the process of the gravity-stable present invention may be applied to any gas injection process. For example, $CO_2$ may be injected in a gaseous solvent oil recovery process. In another embodiment, a thermal process may be conducted by injecting steam. Combinations of oxidizing gas, heating gas and solvent gas may also be used.

The use of a numerical simulator such as that used in the examples below is beneficial for confirming the operability and viability of the design of the present invention for a specific reservoir, and can be readily conducted by reservoir engineers skilled in the art.

BRIEF DESCRIPTION OF THE DRAWINGS

The accompanying drawings, save for FIG. 3, illustrate one or more exemplary embodiments of the present invention and are not to be construed as limiting the invention to these depicted embodiments.

DETAILED DESCRIPTION OF PREFERRED EMBODIMENTS

Figure 1:
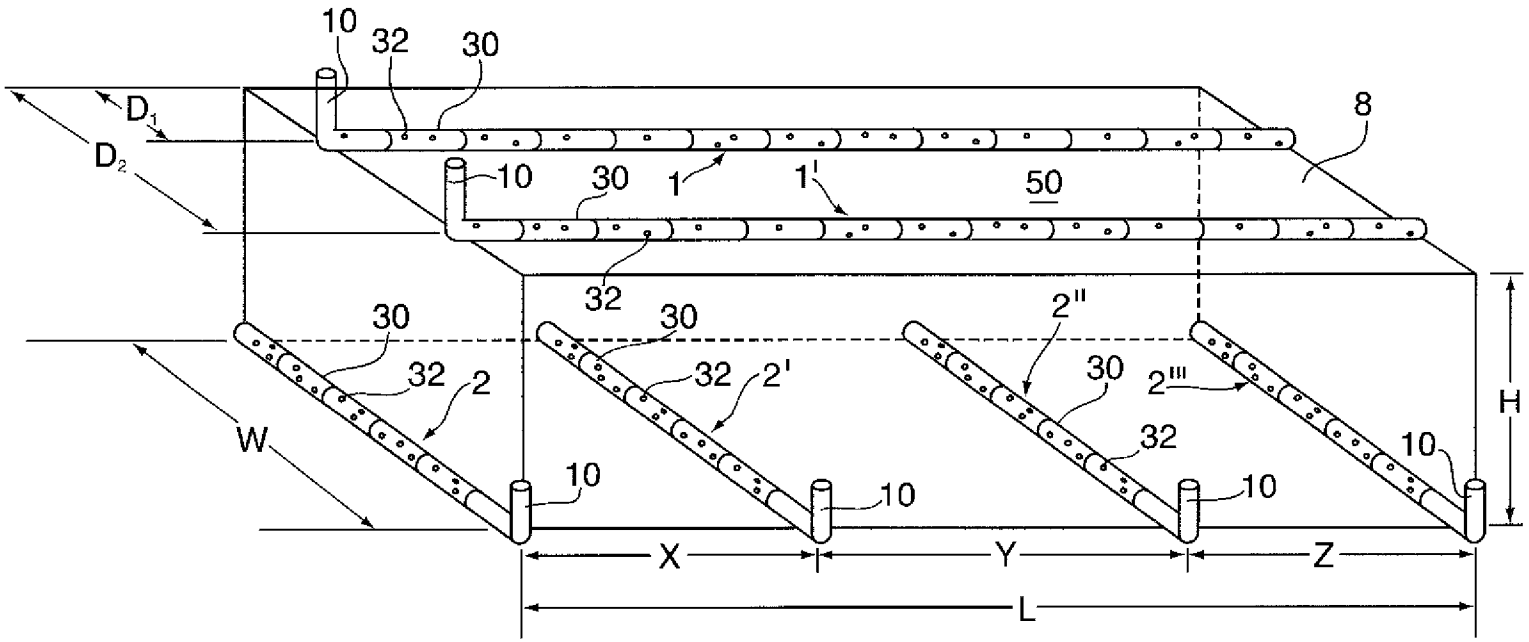
FIG. 1 shows a perspective schematic view of a broad embodiment of the "crossed-wells" method of the present invention, having two injector wells.

FIGS. 1-4 show various embodiments of the crossed-wells method of the present invention, used for extracting oil from an underground hydrocarbon-containing reservoir 20 of height "H", length "L", and width "W".

In each embodiment of the method of the present invention, and as shown in FIGS. 1-4, an upper horizontal injection well 1, and preferably at least two upper horizontal injection wells 1, 1' are drilled in within an upper region 8 of a hydrocarbon-containing reservoir 20, each having a vertical portion 10 (only a lowermost part of which is shown, at the point of communication with upper horizontal injection wells 1, 1') that extends to surface. Where more than one upper horizontal injection well 1 is employed, such upper horizontal injection wells 1, 1' are drilled in parallel, spaced-apart relation to each other, within an upper region 8 of a hydrocarbon-containing reservoir 20. Each of upper injection wells 1, 1' are situated substantially co-planar within a horizontal plane 22 in upper region 8 of reservoir 20.

A plurality of lower horizontal producer wells 2, 2', 2", and 2'" are drilled low in said reservoir 20 parallel to each other, below said upper horizontal wells 1, 1'. Each horizontal well 2, 2', 2", and 2'" likewise has an associated vertical well portion 10 (only a portion of which is shown in FIGS. 1-4), which likewise extends to surface. Each of horizontal production wells 2, 2', 2", and 2' are positioned substantially parallel to each other, but perpendicular to said upper wells 1, 1'.

In a preferred embodiment, each of lower production wells 2, 2', 2", and 2'" have well liner means, typically a plurality of well liner segments 30 situated within such production wells 2, 2', 2", and 2", with the well liner segments 30 each having porous screened slots or apertures 32 therein which serve to allow oil to drain into production wells 2, 2', 2", & 2", but simultaneously prevent sand particles and other detritus from entering production wells 2, 2', 2", & 2".

Figure 2:
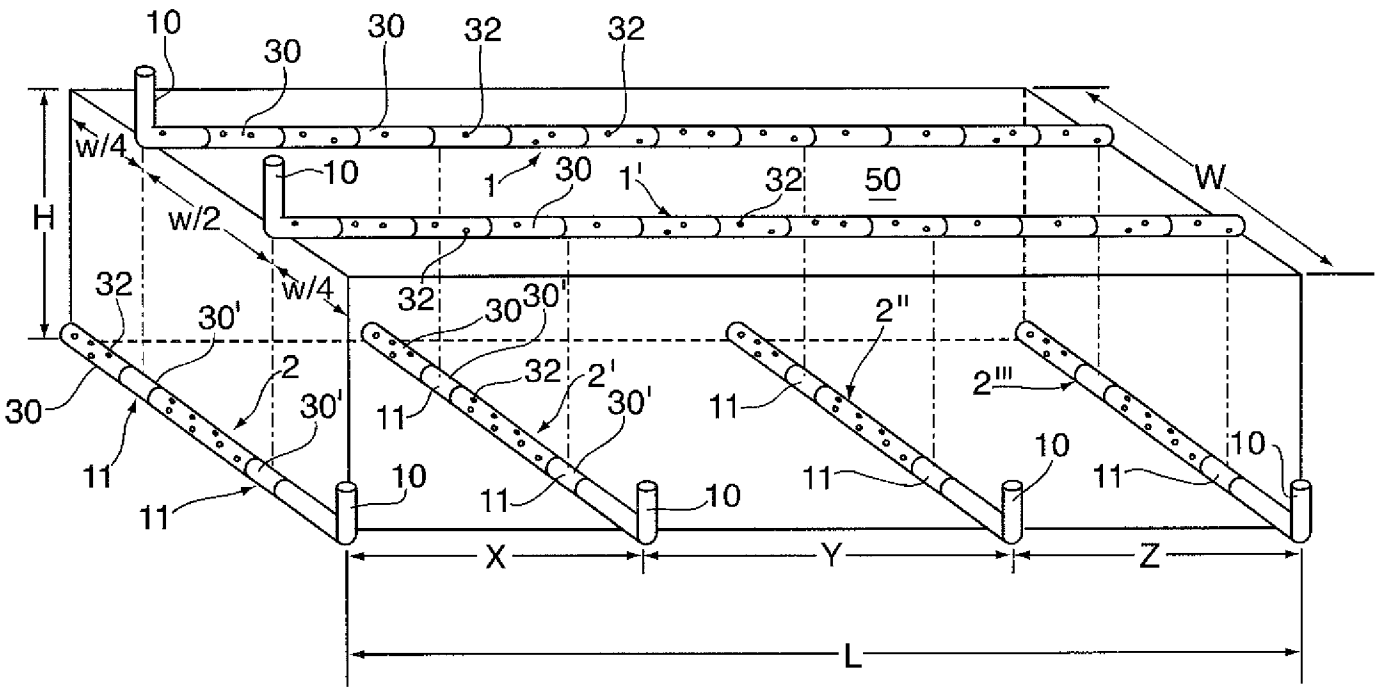
FIG. 2 is a similar perspective schematic view of another preferred embodiment of the "crossed-wells" method of the present invention, where the lower horizontal wells, and in particular well liner means therein, do not possess any apertures in a location immediately below an upper horizontal well where the upper (perpendicular) horizontal well traverses the lower horizontal well, so as to prevent unwanted breakthrough of oxidizing gas at such location.

In a refinement of the invention shown in FIG. 2, two types of well liners 30 and 30' are used in each of production wells 2, 2', 2", & 2. The first type of series of well liners 30 is as described above, having porous screened slots or apertures 32 therein which serve to allow oil to uniformly drain into production wells 2, 2', 2", & 2" but simultaneously prevent sand particles and other detritus from entering production wells 2, 2', 2", & 2". The second type of well liner segment 30' which is inserted in production wells 2, 2', 2", & 2" at various spaced intervals therealong in the manner described below, lacks any apertures therein, and prevents oil (and thus any oxidizing gas from injector wells 1, 1') from entering the production wellbores 2, 2', 2", & 2".

Specifically, well liners 30' are positioned in production wells 2, 2', 2", & 2" at a location 11 in each of said lower horizontal wells 2, 2', 2", & 2" corresponding to point(s) at which a respective upper vertical well 1, 1' traverses a respective lower production well 2, 2', 2", & 2", as shown in FIG. 2. In such manner, oxidizing gas which is injected into formation 20 via apertures 32 in well liners 30 in upper horizontal injection wells 1', 1", is prevented from following the shortest route through formation 20 to such point 11 along production wells 2, 2', 2", & 2", and instead such oxidizing gas is forced through the reservoir 20 in a more circuitous route where there is greater chance that such oxidizing gas will then function as intended and be consumed during oxidation of a portion of the hydrocarbon in such formation 20, thereby providing heat to the remainder of the formation 20 so as to heat oil therein and cause such oil to flow downwardly and into production wells 2, 2', 2", & 2" as intended.

Figure 3:
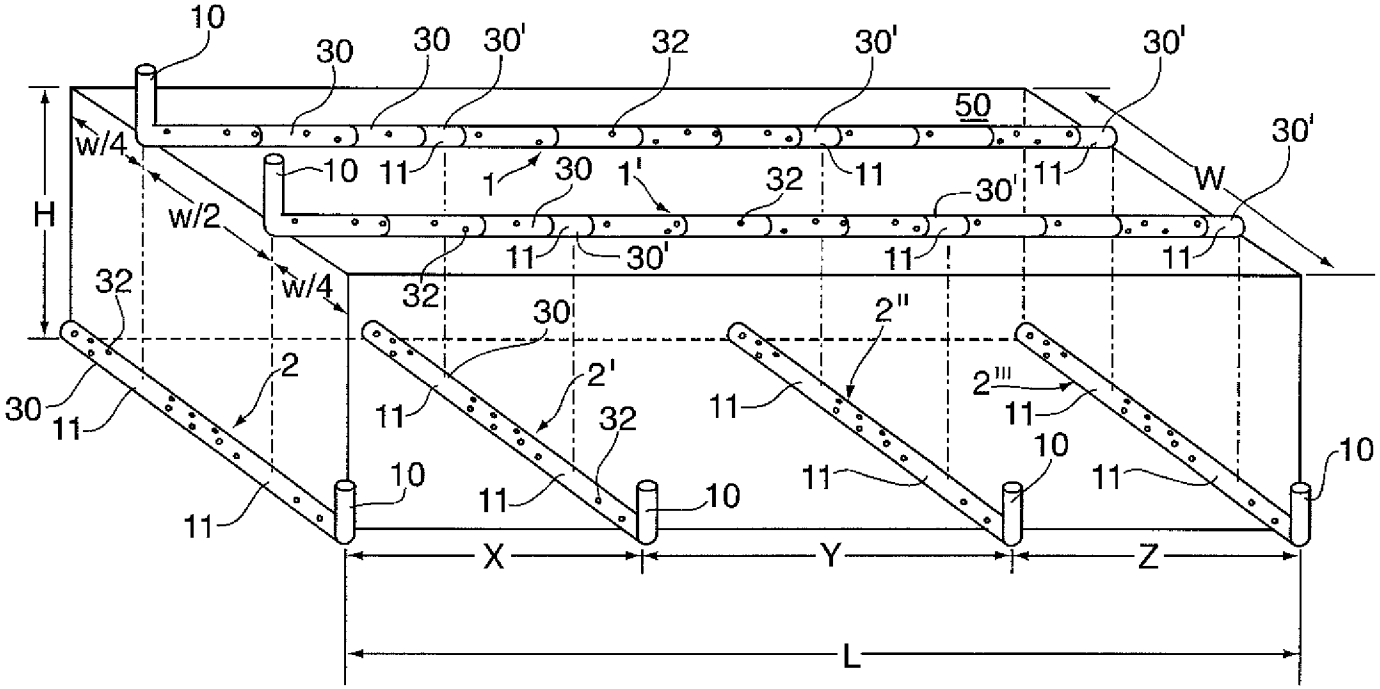
FIG. 3 is a similar perspective schematic view of another preferred embodiment of the "crossed-wells" method of the present invention, where the lower horizontal wells, and in particular well liner means therein, do not possess any apertures in a location immediately below an upper horizontal well where the upper (perpendicular) horizontal well traverses the lower horizontal well, so as to prevent unwanted breakthrough of oxidizing gas at such location.

In an alternative refinement of the invention, shown in FIG. 3, two types of well liners 30 and 30' are used in each of injection wells 1, 1'. The first type of series of well liners 30 is as described above, having porous screened slots or apertures 32 therein which serve to allow fluid 1 to uniformly flow out of injection wells 1, 1' into the reservoir 20 but simultaneously prevent sand particles and other detritus from entering injection wells 1, 1'. The second type of well liner segment 30' which is inserted in injection wells 1, 1' at various spaced intervals therealong in the manner described below, lacks any apertures therein, and prevents oxidizing gas from injector wells 1, 1' at such locations 11 directly above the lower production wells 2, 2', 2", and 2'" from travelling directly downward and entering the production wellbores 2, 2', 2", & 2" at locations 11.

Specifically, in such alternative embodiment (or in addition) well liners 30' are positioned in injection wells 1, 1" at a location 11 in each of said upper horizontal wells 1, 1' corresponding to point(s) at which a respective upper vertical well 1, 1' traverses a respective lower production well 2, 2', 2", & 2", as shown in FIG. 3. In such manner, oxidizing gas which is injected into formation 20 via apertures 32 in well liners 30 in upper horizontal injection wells 1', 1", is prevented from following the shortest route through formation 20 to such point 11 along production wells 2, 2', 2", & 2", and instead such oxidizing gas is forced through the reservoir 20 in a more circuitous route where there is greater chance that such oxidizing gas will then function as intended and be consumed during oxidation of a portion of the hydrocarbon in such formation 20, thereby providing heat to the remainder of the formation 20 so as to heat oil therein and cause such oil to flow downwardly and into production wells 2, 2', 2", & 2" as intended.

In the embodiments shown in FIG. 1, FIG. 2, and FIG. 3 having two injection wells 1, 1', the lateral distance spacing of injector well 1 (ie well number 1) from a vertical side wall 50 of the rectangular volume of length L, width W, and height H) is a distance D1, and similarly the lateral distance spacing injector well 1' from vertical side wall is a distance D2, which in the case of injector well 1 such distance D1 is w/4, whereas the lateral distance spacing of second injector well 1' (ie progressively numbered well number "2") from vertical side wall 50, namely distance D2, is a distance:

$$W/4+W/2=3/4W$$

so as to produce the desired symmetric positioning of injector wells 1, 1' when developing reservoir 20 for production.

For an embodiment of the method of the present invention using a single injector well 1 (not shown), the desired position within reservoir 20 is a distance w/2 from vertical side wall 50, namely directly in the middle of reservoir 20 having a width W equal to 100 m.

More generally, therefore, for any number "n" of injection wells, for desired symmetric positioning of such injector wells 1, 1', . . . 1$^{n}$ in reservoir 20, said reservoir having a width "W" and a number of upper horizontal injector wells "n" spaced along said width "W", each of said upper injection wells 1, 1', . . . 1$^{n}$ being designated with a respective successive well number "wn", namely 1, 2, 3, . . . n, progressing from said vertical side 50, wherein distance "$D_{wn}$" for each respective progressively-numbered upper injection wells wn from said vertical side 50 is determined by the formula $D_{wn}$=W*[2*wn−1]/2n, which results in correct desired symmetric positioning of injectors wells 1, 1', . . . 1$^{n}$ in reservoir 20.

Figure 4:
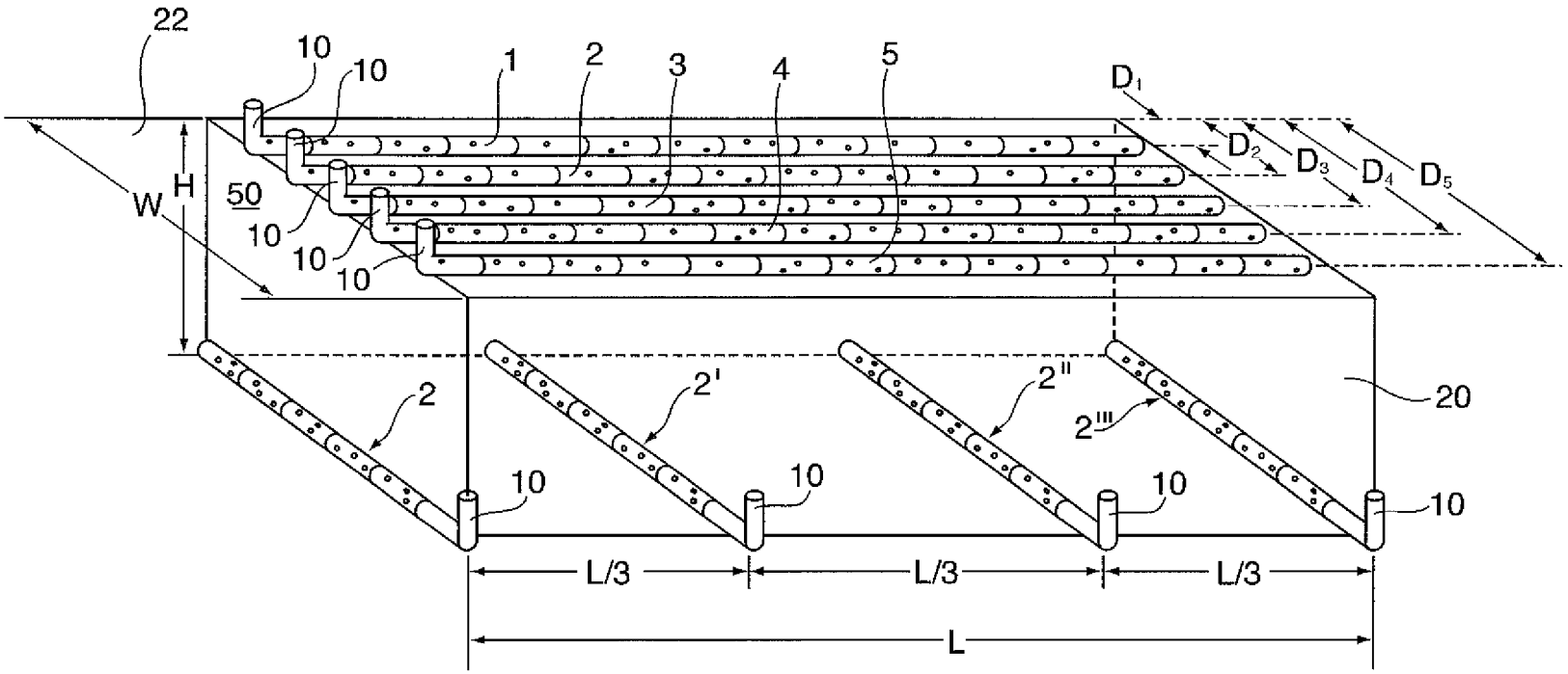
FIG. 4 is a perspective schematic view of a broad embodiment of the "crossed-wells" method of the present invention, having five injector wells.

Accordingly, in a refinement of the invention shown in FIG. 4, in order to demonstrate desired lateral positioning of upper injector wells 1, 1' in relation to formation 20 where more than two upper injector wells 1, 1' are utilized, five (5) injector wells 1, 2, 3, 4, & 5 are shown in the embodiment shown in FIG. 3, respectively identified as well number 1, well number 2, well number 3, well number 4, and well number 5. Such wells 1-5 are drilled with the distances from vertical side wall 50 being distances D1, D2, D3, D4, and D5 respectively, as shown in FIG. 3 where D1=W/10, D2=3W/10, D3=5W/10, D4=7W/10, and D5=9W/10, in order to produce the desired spacing of injection wells (injection well numbers 1-5) relative to each other and with desired symmetric positioning within formation 20.

In operation, the "crossed-wells" method of the present invention of FIG. 1 is carried out as follows.

A least one parallel, upper horizontal injection well 1 is drilled within an upper region 8 of said hydrocarbon-containing reservoir 20 and substantially within a horizontal plane 22 therein, and if two or more injection wells 1, 1' are drilled such wells 1, 1' are drilled in parallel relation but laterally spaced apart.

A plurality of parallel, lateral spaced apart lower horizontal producer wells 2, 2' are drilled relatively low in said hydrocarbon containing reservoir 20 below said upper horizontal well(s) 1, 1" and positioned substantially parallel to each other but perpendicular to said upper well(s) 1, 1'.

An fluid (not shown), such as a heated fluid such as steam, a diluent such as $CO_2$ or a hydrocarbon diluent is injected into each of said upper horizontal well(s) and into said reservoir 20 via apertures 32 in each of said pair of upper horizontal wells 1, 1'.

Oil which has migrated downwardly in said subterranean reservoir 20 is recovered in said lower horizontal wells 2, 2; and thereafter recovered from said lower horizontal wells 2, 2', to surface.

The methodology for the "crossed-wells" method of FIG. 2 and FIG. 3 is identical, save for the additional steps, prior to the step of injecting oxidizing gas, of using impervious well liner segments 30', or inserting sealing "blanks" to seal well liners in upper wells 1, 1' and/or lower wells 2, 2', 2", or 2'" to prevent "short circuiting".

Specifically, as regards the method depicted in FIG. 2 well liner means in the form of well liner segments 30 are introduced within said lower horizontal wells 2, 2', 2", and 2'", wherein the well liner segments 30 having apertures 32 therein to allow ingress of oil into the lower horizontal wells 2, 2', 2", and 2'", and are situated within horizontal wells 2, 2', 2", and 2'", but at locations 11 in each of said lower horizontal wells 2, 2', 2'", and 2" directly below points at which an upper horizontal well 1, 1' respectively traverses each lower horizontal well, well liner segments 30' not having any apertures 32 therein are positioned.

Similarly, as regards the method depicted in FIG. 3 well liner means in the form of well liner segments 30 are introduced within said upper horizontal wells 1, 1'", wherein the well liner segments 30 having apertures 32 therein to allow egress of fluid from the injection wells 1, 1' into formation 20, but at locations 11 in each of said upper horizontal wells 1, 1', directly above points at which an upper horizontal well 1, 1' respectively traverses each lower horizontal well, well liner segments 30' not having any apertures 32 therein are positioned, to thereby prevent "short circuiting" of fluid via the shortest downward path, namely to location 11 within a lower production well 2, 2', 2", and 2'".

Where in situ combustion is used as the means of increasing the viscosity of oil in the formation, the "crossed-wells" method of the present invention of FIG. 1 is carried out as follows.

A least one parallel, upper horizontal injection well 1 is drilled within an upper region 8 of said hydrocarbon-containing reservoir 20 and substantially within a horizontal plane 22 therein, and if two or more injection wells 1, 1' are drilled such wells 1, 1' are drilled in parallel relation but laterally spaced apart.

A plurality of parallel, lateral spaced apart lower horizontal producer wells 2, 2' are drilled relatively low in said hydrocarbon containing reservoir 20 below said upper horizontal well(s) 1, 1" and positioned substantially parallel to each other but perpendicular to said upper well(s) 1, 1'.

An oxidizing gas (not shown), is injected into each of said upper horizontal well(s) and into said reservoir 20 via apertures 32 in each of said pair of upper horizontal wells 1, 1', and allowed to combust within the reservoir 20, thereby heating oil within such reservoir 20.

Typically, the ignition of the oxidizing gas and a portion of the oil in the formation in contact with such oxidizing gas is accomplished by known means, such as briefly heating the reservoir 20 near the upper injection well 1 and/or 1' with hot gas such as steam, and subsequently injecting oxidizing gas, wherein oil in the formation, due to the elevated temperatures therein due to the earlier steam injection, will then spontaneously auto-ignite. Alternatively, electrical heaters may be used, to bring the temperature of oil in regions of the heater up to sufficient combustion temperature, where injection of air when coming into contact with heated oil will cause auto-ignition and spontaneous combustion of the oil and thus commencement of in-situ combustion within the reservoir 20. Alternatively, but equally effective, a small quantity of linseed oil may be injected into the reservoir 20 (which typically has a low temperature of combustion), and injecting compressed air into the reservoir of a sufficient temperature (air becomes heated during compression) to cause ignition of the linseed oil, which thereafter ignites oil in the reservoir 20 which comes into contact with sufficient injected oxidizing gas in reservoir 20.

Oil which has become heated and migrated downwardly in said subterranean reservoir 20 is similarly recovered in said lower horizontal wells 2, 2; and thereafter recovered from said lower horizontal wells 2, 2', to surface.

Figure 5:
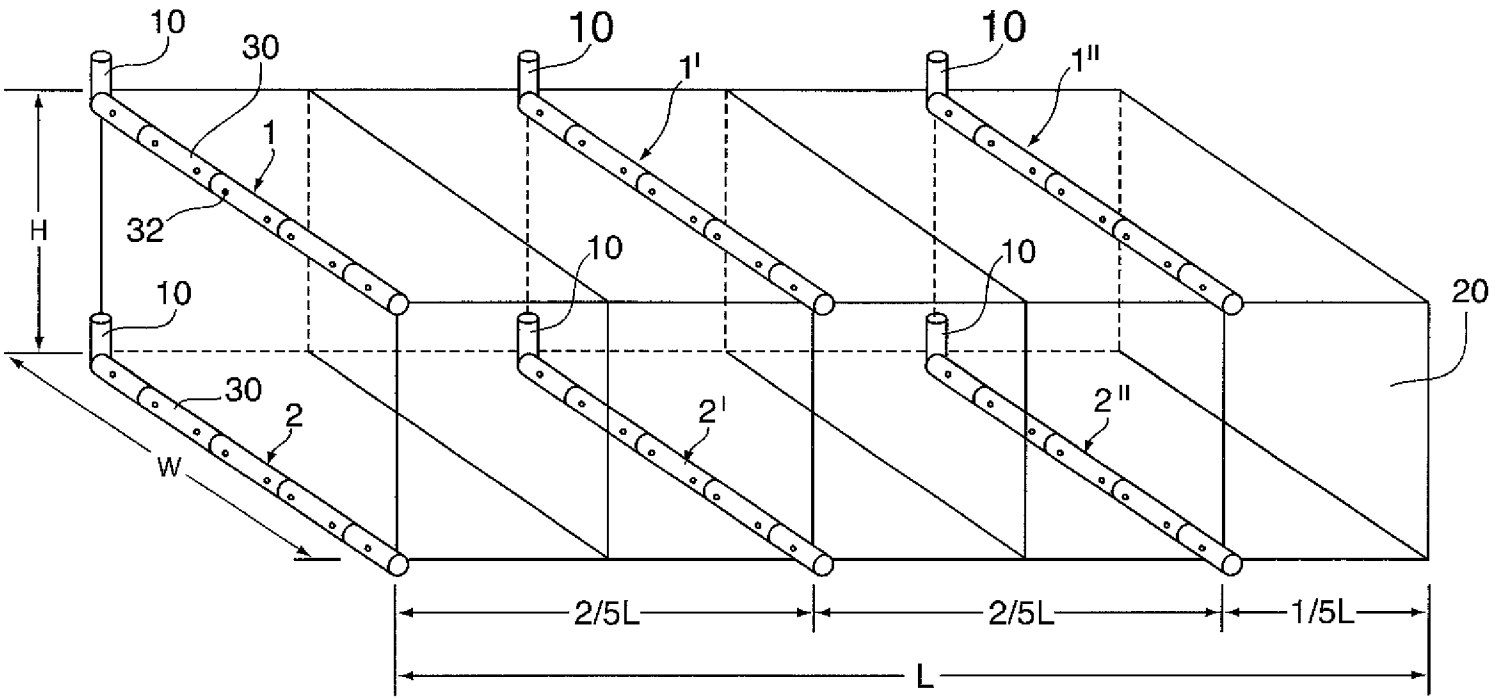
FIG. 5 shows a perspective schematic view of a subterranean hydrocarbon-containing formation, showing a method as disclosed in Canadian Patent 2,698,454 wherein pairs of upper and lower horizontal wells are drilled in a hydrocarbon-containing formation parallel to and vertically spaced apart from each other, and lower horizontal wells are drilled immediately beneath a corresponding upper horizontal well, and the well pairs are all parallel to one another, such method depicted in FIG. 5 not forming part of the present invention and depicted to show a comparison method of oil recovery used in the comparative Examples referred to in herein.

FIG. 5 shows an alternative method of oil recovery, namely a method which is disclosed and claimed in CA 2,698,454 published Nov. 1, 2011 and commonly assigned to the Applicant herein.

In such method shown in FIG. 5, an upper horizontal injector well 1, 1', 1" is drilled immediately above respective lower production wells 2, 2', and 2". Well liners 30 are similarly situated in each of upper injection wells 1, 1', 1", having apertures 32 therein to allow injection of oxidizing gas into formation 20, and likewise well liner segments 30 with similar apertures 32 therein may similarly be utilized in production wells 2, 2', and 2" to allow ingress of oil into said production wells 2, 2', and 2"

EXAMPLE 1

In order to compare the oil recovery factor capable of being achieved using the "crossed-wells" method of the present invention shown in FIG. 1 with another alternative method of oil recovery, namely the method and well configuration shown in FIG. 5 (which does not form part of the present invention) extensive computer simulation of both methods of recovery of mobile oil were undertaken using the STARS™ Thermal Simulator 2010.12 provided by the Computer Modelling Group, Calgary, Alberta, Canada.

As regards the model dimensions used for comparing the cumulative oil recovery capable of being achieved, respectively, for each of the well configurations shown in FIG. 1 and FIG. 5, the number of grid blocks for each were 20×50×20, and the grid block sizes were respectively 5.0 m, 5.0 m and 1.0 m, resulting in the same total reservoir volume in each case of 500,000 $m^3$ (ie 100 m width "W"×250 m length "L"×20 m height "H").

The modelling reservoir used in each of comparative methods herein contained bitumen at elevated temperature (54.4° C.) with high rock permeability.

In each of comparative methods of FIG. 1 and FIG. 5 the total number of wells used for comparative purposes was the same. Specifically, with regard to the "crossed-wells" configuration/method as shown in FIG. 1, a total of five (5) wells were used, namely two (2) injection wells 1', 1", and three (3) production wells 2, 2', 2" and 2'", again keeping in mind that lower production wells 2 and production well 2"" which each appear at the end of the grid block reservoir 20 shown in FIG. 1 are counted as half-wells. The width W of the formation 20 was 100 m, while the height H was 20 m. Distance D1 was 25 m, while Distance D2 was 75 m. Distances "X" and "Z" were 83.33 m, and distance 'Y" was 83.33 m, for a total length L of the reservoir of 250 m.

Likewise, with regard to the method of oil recovery depicted in FIG. 5, at similar total of five (5) wells was used for comparative purposes, namely two and one half injector wells 1, 1', and 1", and a total of two and one half lower collector wells 2, 2', & 2", again keeping in mind that each of upper and lower wells 1, 2 respectively that appear at the end of the first grid block in reservoir 20 shown in FIG. 5 are counted as half-wells. The distance separating lower production wells 2, 2', and 2', 2" in FIG. 5 was ⅖L, namely 100 m, while the distance separating production well 2" and the end of the grid block was ⅕L, namely 50 m.

With regard to each comparative configurations depicted in FIGS. 1 & 5 hereto, each received an identical amount of oxidizing gas (air) injection, namely a total of 50,000 $m^3$/day, with each of injection wells 1 and 1' of FIG. 1 receiving 25,000 m3/day for a total of 50,000 $m^3$/day. Similarly, as regards the method depicted in FIG. 5, injection well 1 received 10,000 $m^3$/day air injection, while wells 1' and 1" received 20,000 $m^3$/day, for a similar total of 50,000 $m^3$/day of air injection.

For combustion simulations with air the reactions used:

1. 1.0 Oil→0.42 Upgrade ($C_{16}H_{34}$)+1.3375 $CH_4$+29.6992 Coke
2. 1.0 Oil+13.24896 $O_2$→5.949792 $H_2O$+6.0 $CH_4$+9.5 $CO_2$+0.5 CO/N2+27.3423 Coke
3. 1.0 Coke+1.2575 $O_2$→0.565 $H_2O$+0.95 $CO_2$+0.05 CO/N2

In order to improve sweep efficiency, the transmissibility of the oil production wells 2, 2', 2", and 2'" was varied monotonically from 1.0 at the toe to 0.943 at the heel. Additional reservoir properties for each of the reservoirs 20 and comparative methods of oil extraction modelled in FIG. 1 & FIG. 4 are set out in TABLE 1, below:

TABLE 1

Reservoir properties, oil properties and well control.

| Parameter | Units | Value |
|---|---|---|
| Reservoir Properties | | |
| Pay thickness | m | 20 |
| Porosity | % | 30 |
| Oil saturation | % | 80 |
| Water saturation | % | 20 |
| Gas mole fraction | fraction | 0.263 |
| H. Permeability | mD | 5000 |
| V. Permeability | mD | 3400 |
| Reservoir temperature | ° C. | 54.4 |

TABLE 1-continued

Reservoir properties, oil properties and well control.

| Parameter | Units | Value |
|---|---|---|
| Reservoir pressure | kPa | 3000 |
| Rock compressibility | /kPa | 3.5E−5 |
| Conductivity | J/m · d · C | 1.5E+5 |
| Rock Heat capacity | J/m$^3$-C | 2.35E+6 |
| Oil Properties | | |
| Density | Kg/m$^3$ | 1009 |
| Viscosity, dead oil @ 20 C. | cP | 77,000 |
| Viscosity, in situ | cP | 1139 |
| Average molecular weight oil | AMU | 598 |
| Average molecular weight Upgrade | AMU | 224 |
| Oil mole fraction | Fraction | 0.737 |
| Compressibility | /kPa | 1.06E+3 |
| The wells were controlled using the following parameters: | | |
| Maximum air injection pressure | kPa | 7,000 |
| Horizontal well length | m | 500 |
| Producer BHP minimum | kPa | 2600 |
| Total air or steam injection rate | m$^3$/d | 50,000 |

Air was injected continuously via injection wells 1, 1' (and also 1" in the case of the method of FIG. 5), and oil, water and gas were produced continuously from the lower wells 2, 2', 2" (and also 2'" in the case of the method of FIG. 1).

Table 2 below shown the performance of the reservoir recovery method depicted in FIG. 1 and the reservoir recovery method depicted in FIG. 4.

TABLE 2

Model performance after 5-years.

| Run # | Well Arrangement | Cumulative Oil 5-years (1827 days) | Days to RF 80.5% | Cumulative Air/Oil Ratio at 80.5% RF |
|---|---|---|---|---|
| 1* | Air Injectors parallel and above the Producer (FIG. 5) | 81700 | 3233 | 1270 |
| 2 | Crossed air injectors (FIG. 1) | 93274 | 1827 | 980 |

*Not part of the present invention

Referring to Table 2, the present invention of FIG. 1 with crossed horizontal wells 2, 2', 2", and 2"" provides substantially improved oil production with 80.5% oil recovery by 5-years, 14% higher than by the method of FIG. 5. The method of FIG. 5 took 3233 days to reach 80.5% oil recovery, compared with 1827 days for the present invention shown in FIG. 1.

Furthermore, as shown by the air-oil-ratios at 80.5% oil recovery, the air compression energy was 26% higher for the method depicted in FIG. 5.

As seen from the results of Table 2, the "crossed-wells" method of the present invention shown in FIG. 1 is more economical than the method of FIG. 5 because of initial accelerated oil production rate, while requiring less oxidizing gas compression energy.

EXAMPLE 2

Figure 6:
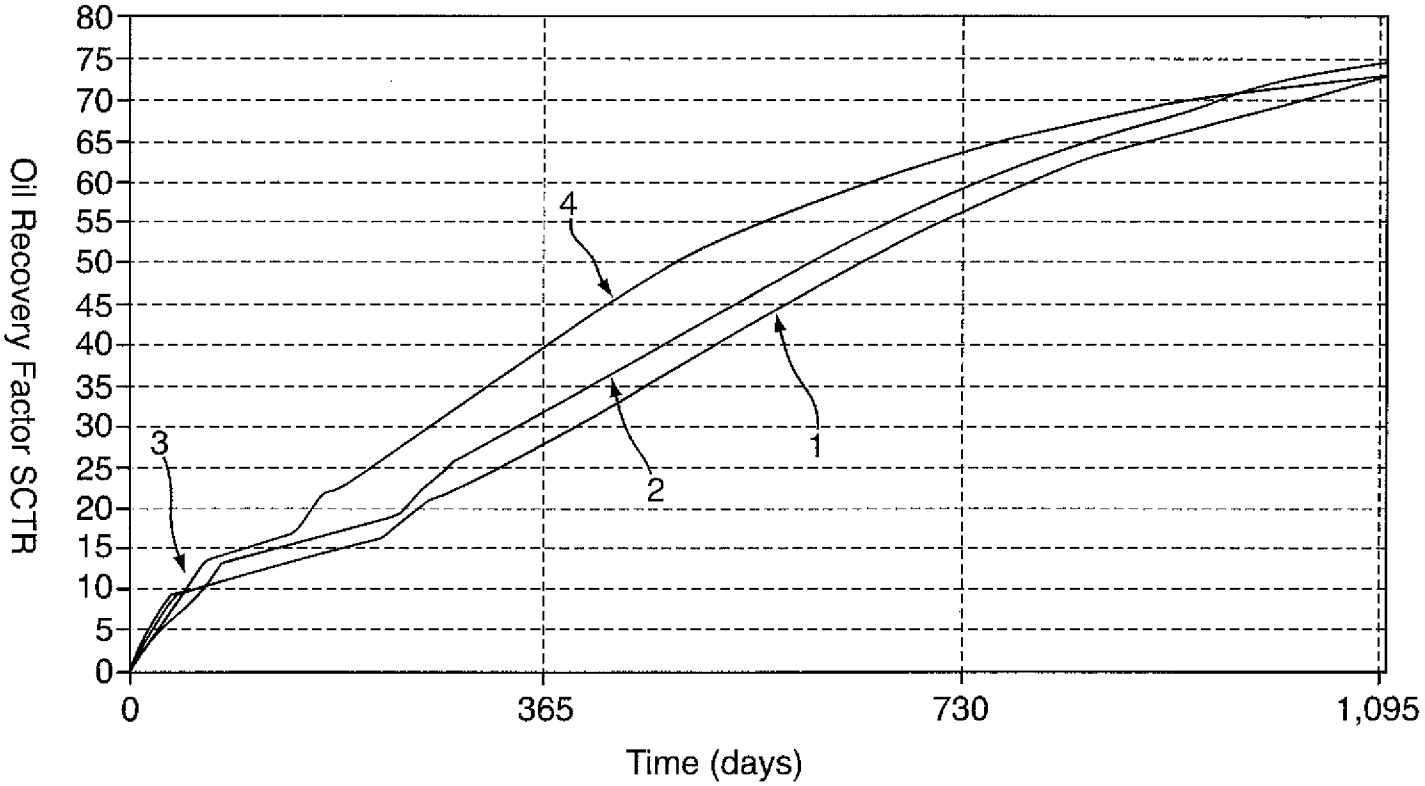
FIG. 6 is a series of graphs showing oil recovery factor versus time (days) for the method of the present invention shown in FIG. 1 (line 1) and the method of the present invention shown in FIG. 2 (line 2), each using an injection rate of oxidizing gas of 100,000 $m^3$/day, and further showing oil recovery factor versus time (days) for the method of the present invention shown in FIG. 1 (line 3) and the method of the present invention shown in FIG. 2 (line 4), each using an injection rate of oxidizing gas of 200,000 $m^3$/day.

In order to measure the value of the preferred embodiment of the method of the present invention shown in FIG. 2 (namely a method using strategically placed well liners 30' having no apertures therein (ie 'blank' sections) at strategic locations along each of the lower horizontal production wells 2, 2', 2", and 2'") and determine if any performance improvement or operability improvement exists over the method of the present invention of FIG. 1 which does not make use of such well liners 30' and instead uses well liners 30 throughout a width of each production well 2, 2', 2", and 2'", computer simulations were conducted for identically reservoir conditions, namely those reservoir conditions identical to those of Example 1 above for each of the methods of FIG. 1 and FIG. 2, save and except that the air injection rate was firstly doubled to 100,000 m$^3$/d (50,000 m$^3$/day for each injection well 1, 1') for each method of FIG. 1 and FIG. 2, and in a further test run n quadrupled to 200,000 m$^3$/d (100,000 m$^3$/day for each injection well) for each method. The cumulative oil recovery rate over time was graphed for each of the two methods, at the two air injection rates of 100 m3/day and 200 m3/day, as shown in FIG. 6.

With regard to the models used to respectively emulate the methods of FIG. 1 and FIG. 2, the reservoir dimensions where identical, and further were identical to those identified above in respect of FIG. 1 used in Example 1.

In the method of FIG. 2, the "blank" (ie non-perforated) well liner segments 30', blank segments of 15 m in length were inserted at location 11 of FIG. 2. For the twenty grid blocks of 5-meter length representing the combined length "W" of 100 m of horizontal production wells 2, 2', 2", and 2'", the specific wellbore fluid transmissibilities employed were:

1.000 TOE; 0.997; 0.994; 0.991 or 0.000 (BLANK); 0.988 or 0.000 (BLANK); 0.985 or 0.000 (BLANK); 0.982; 0.979; 0.976; 0.973; 0.970; 0.967; 0.964; 0.961 or 0.000 (BLANK); 0.958 or 0.000 (BLANK); 0.955 or 0.000 (BLANK); 0.952; 0.952; 0.949; 0.946; 0.943 HEEL. The length off the blank sections 30' employed was 15 meters, centered at location 11 directly below the crossing injection wells 1, 1'.

Specifically, with reference to FIG. 5, line "1" shows the cumulative oil recovery for the method of FIG. 1, using a 100,000 m$^3$/day injection rate. Line '2' shows the cumulative oil recovery for the method of FIG. 2, similarly using a 100,000 m$^3$/day injection rate. Clearly, at 100,000 m$^3$/d, there was no problem of oxygen in the producer either without or with blank sections (lines 1 and 2), although the use of the method of FIG. 2 produced a slightly better cumulative oil recovery factor.

Line '3' of FIG. 6 shows the method of FIG. 1 using air injection of 200,000 m$^3$/day, and line '4" shows the method of FIG. 2 at a similar air injection rate of 200,000 m$^3$/day.

Notably, as can be seen from truncated line '3' (ie method of FIG. 1 at 200 m3/d air injection rate, the model having no blank sections), such model's operation (Line 3) failed after 30 days with high oxygen breakthrough into the producer wells. In contrast, the model depicting the method of FIG. 2 with blank sections (line 4) operated safely to completion and production rates were substantially better.

After 1-year, the oil recovery factor was 40% with blank sections for the method of FIG. 2 and 200 m3/day air injection (ie line 4) and only 26% (ie line 2, depicting FIG. 2 albeit with ½ the air injection).

Example 2 demonstrates the important benefits of strategically inserting blank joints (ie non-perforated well liners 30', containing no apertures) in the horizontal production wells 2, 2', 2", and 2" 'of the "crossed-wells" method of the present invention, which allows higher air injection rates, and thus higher initial oil recovery.

The scope of the claims should not be limited by the preferred embodiments set forth in the foregoing examples, but should be given the broadest interpretation consistent with the description as a whole, and the claims are not to be limited to the preferred or exemplified embodiments of the invention.

The invention claimed is:

1. A method for recovering oil from a hydrocarbon-containing subterranean reservoir, comprising the steps of:

(i) drilling at least one upper horizontal injection well within an upper region of said hydrocarbon-containing reservoir;

(ii) drilling, relatively low in said reservoir and beneath said at least one upper well, a plurality of parallel lower horizontal producer wells, situated low in said hydrocarbon-containing reservoir each positioned substantially parallel to each other but below and perpendicular to said at least one upper horizontal injection well such that said at least one upper injection well passes over said parallel lower horizontal producer wells;

(iii) injecting a fluid into said at least one upper horizontal injection well and injecting said fluid into said reservoir via apertures in said at least one upper horizontal injection well;

(iv) recovering oil which has migrated downwardly in said subterranean reservoir, via said lower horizontal wells; and (v) recovering said oil from said lower horizontal wells to surface.

2. The method for recovering oil from a hydrocarbon-containing subterranean reservoir as claimed in claim 1 wherein said fluid contains steam or a non-oxidizing gas.

3. The method for recovering oil from a hydrocarbon-containing subterranean reservoir as claimed in claim 1 wherein said fluid is carbon dioxide gas.

4. The method for recovering oil from a hydrocarbon-containing subterranean reservoir as claimed in claim 1, wherein said fluid contains a solvent gas for reducing the viscosity of oil within said reservoir.

5. The method for recovering oil from a hydrocarbon-containing subterranean reservoir as claimed in claim 1 wherein said fluid further contains a solvent gas for reducing the viscosity of oil within said reservoir, and said solvent gas is carbon dioxide or a light hydrocarbon.

6. An in situ combustion method for recovering oil from a hydrocarbon-containing subterranean reservoir, comprising the steps of:

(i) drilling at least one upper horizontal well within an upper region of said hydrocarbon-containing reservoir;

(ii) drilling, relatively low in said reservoir and beneath said at least one upper well, a plurality of parallel lower horizontal wells, situated low in said hydrocarbon containing reservoir below said at least one upper horizontal well, each lower horizontal well positioned substantially parallel to each other but each positioned perpendicular to said at least one upper horizontal well;

(iii) injecting an oxidizing gas into said upper horizontal well and injecting said oxidizing gas into said reservoir via apertures in said upper horizontal well;

(iv) combusting a portion of oil within said formation which comes into contact with said oxidizing gas and causing non-combusted oil in said formation to become heated;

(v) recovering said non-combusted oil which has become heated and which has migrated downwardly in said subterranean reservoir, via said lower horizontal wells; and (vi) recovering said oil from said lower horizontal wells to surface.

7. The method for recovering oil from a hydrocarbon-containing subterranean reservoir as claimed in claim 6, comprising the further steps of, subsequent to step (ii) above, of:

(a) introducing well liner means within said lower horizontal wells, said well liner means having apertures therein to allow ingress of oil into said lower horizontal wells, said well liner means, at locations in each of said lower horizontal wells directly below points of traverse where said upper horizontal well traverses and passes over said lower production wells, not having any apertures therein proximate said points of traverse.

8. The method for recovering oil from a hydrocarbon-containing subterranean reservoir as claimed in claim 1, 6, or 7, comprising the further steps of, prior to step (v) above, of:

(a) introducing and locating well liner means within said upper horizontal well, said well liner means having apertures therein to allow egress of a fluid therethrough and into said formation, said well liner means at locations in said upper horizontal well directly above points of traverse where said upper horizontal traverses and passes over one or more of said lower horizontal wells, not having any apertures therein proximate said points of traverse.

9. The method for recovering oil from a hydrocarbon-containing subterranean reservoir as claimed in claim 7, wherein said oxidizing gas injection rate is approximately equal to or greater than 200,000 m3/day.

10. The method for recovering oil from a hydrocarbon-containing subterranean reservoir as claimed in claim 7, wherein said oxidizing gas injection rate is approximately equal to or greater than 200,000 m3/day.

11. The method for recovering oil from a hydrocarbon-containing subterranean reservoir as claimed in claim 7 wherein said upper horizontal wells and said lower horizontal wells are separated by a distance less than or equal to 20 m.

12. The method for recovering oil from a hydrocarbon-containing subterranean reservoir as claimed in claim 1 or 6, comprising the further steps of, subsequent to step (ii) above, of:

(a) introducing well liner means within said lower horizontal wells, said well liner means having apertures therein to allow ingress of oil into said lower horizontal wells;

(b) inserting within or over said well liner means a cylindrical hollow member of a finite length having no apertures on a circumference thereof, at locations in or on each of said lower horizontal wells which are directly below points of traverse where said upper horizontal well traverses and passes over said lower production wells, to thereby block such apertures at such locations and thereby block a direct route of travel by the injected fluid from the upper injection well directly downwards into the lower production well at such point(s) of traverse.

13. The method for recovering oil from a hydrocarbon-containing subterranean reservoir as claimed in claim 1 or 6, comprising the further steps of, subsequent to step (ii) above, of:

(a) introducing well liner means within said upper horizontal well, said well liner means having apertures therein to allow egress of fluid from said upper horizontal well into said formation;

(b) inserting within or over said well liner means a cylindrical hollow member of a finite length having no apertures on a circumference thereof, at locations on said upper horizontal well which are directly above points of traverse where said upper horizontal well traverses and passes over said lower production wells, to thereby block such apertures at such locations and thereby block a direct route of travel by the injected fluid from the upper injection well directly downwards into the lower production well at such point(s) of traverse.

14. The method for recovering oil from a hydrocarbon-containing subterranean reservoir as claimed in claim 6 wherein said upper horizontal wells and said lower horizontal wells are separated by a distance less than or equal to 20 m.

15. The method for recovering oil from a hydrocarbon-containing subterranean reservoir as claimed in claim 1 or 6, said reservoir having a width "W" and a number of upper horizontal injector wells "n" spaced along said width "W", wherein each of said upper injector wells are laterally spaced a distance "D" along said width from a vertical side of a rectangular area of said reservoir containing said upper injector wells and lower horizontal production wells, each of said upper injection wells being designated with a successive well number "wn" progressing from said vertical side, wherein said distance "D" of each progressively numbered upper injection wells wn from said vertical side is determined by the formula D=W* [2*wn−1]/2n, and spacing said injection wells within said formation in accordance with said formula.

16. The method for recovering oil from a hydrocarbon-containing subterranean reservoir as claimed in claim 6 wherein hot combustion gases are further drawn into and recovered to surface from said lower horizontal wells along with said oil.

17. The method for recovering oil from a hydrocarbon-containing subterranean reservoir as claimed in claim 6 wherein said oxidizing gas contains steam or a non-oxidizing gas, or carbon dioxide.

18. The method for recovering oil from a hydrocarbon-containing subterranean reservoir as claimed in claim 6, wherein said oxidizing gas further contains a solvent gas for reducing the viscosity of oil within said reservoir.

19. The method for recovering oil from a hydrocarbon-containing subterranean reservoir as claimed in claim 18 wherein said solvent gas is carbon dioxide or a light hydrocarbon.

20. The method for recovering oil from a hydrocarbon-containing subterranean reservoir as claimed in claim 6, wherein said oxidizing gas comprises air or oxygen gas.

21. An in situ combustion method for recovering oil from a hydrocarbon-containing subterranean reservoir, comprising the steps of:

(i) drilling at least a pair of parallel, spaced-apart, upper horizontal wells within an upper region of said hydrocarbon-containing reservoir and each substantially within a horizontal plane therein;

(ii) drilling, relatively low in said reservoir and beneath said at least one upper well, a plurality of parallel lower horizontal wells low in said hydrocarbon-containing reservoir below said upper horizontal wells and positioned substantially parallel to each other but perpendicular to said upper wells;

(iii) placing a well liner means within said lower horizontal wells/or said upper injection wells; said well liner means having apertures therein;

(iv) injecting an oxidizing gas into each of said upper horizontal wells and injecting said oxidizing gas into said reservoir via apertures in each of said pair of upper horizontal wells;

(v) combusting oil in said formation which comes into contact with said oxidizing gas and causing non-combusted oil in said formation to become heated;

(vi) recovering non-combusted oil which has become heated and which has migrated downwardly in said subterranean reservoir, via said lower horizontal wells; and (vii) recovering said oil from said lower horizontal wells to surface.

22. The in situ combustion method for recovering oil from a hydrocarbon-containing subterranean reservoir as claimed in claim 21, said well liner means at locations within said horizontal wells at points at which a respective upper well perpendicularly traverses a respective lower well, being impervious so as to prevent oxidizing gas injected in said upper horizontal wells from flowing directly downwardly into said lower horizontal wells at such point at which said lower wells are traversed by said upper wells.

23. The method for recovering oil from a hydrocarbon-containing subterranean reservoir as claimed in claim 21, said step (iii) further comprising the steps of:

(a) introducing well liner means within said lower horizontal wells, said well liner means having apertures therein to allow ingress of oil into said lower horizontal wells, said well liner means, at locations in each of said lower horizontal wells directly below points of traverse where said upper horizontal well traverses and passes over said lower production wells, not having any apertures therein proximate said points of traverse.

24. The method for recovering oil from a hydrocarbon-containing subterranean reservoir as claimed in claim 21, said step (iii) further comprising the steps of:

(a) introducing and locating well liner means within said upper horizontal well, said well liner means having apertures therein to allow egress of a fluid therethrough and into said formation, said well liner means at locations in said upper horizontal well directly above points of traverse where said upper horizontal traverses and passes over one or more of said lower horizontal wells, not having any apertures therein proximate said points of traverse.

25. The method for recovering oil from a hydrocarbon-containing subterranean reservoir as claimed in claim 21, said step (iii) further comprising the steps of:

(a) introducing well liner means within said lower horizontal wells, said well liner means having apertures therein to allow ingress of oil into said lower horizontal wells;

(b) inserting within or over said well liner means a cylindrical hollow member of a finite length having no apertures on a circumference thereof, at locations in or on each of said lower horizontal wells which are directly below points of traverse where said upper horizontal wells traverse and pass over said lower production wells, to thereby block such apertures at such locations and thereby block a direct route of travel by the injected fluid from the upper injection well directly downwards into the lower production well at such point(s) of traverse.

26. The method for recovering oil from a hydrocarbon-containing subterranean reservoir as claimed in claim 21, said step (iii) further comprising the steps of:

(a) introducing well liner means within said upper horizontal well, said well liner means having apertures therein to allow egress of fluid from said upper horizontal well into said formation;

(b) inserting within or over said well liner means a cylindrical hollow member of a finite length having no apertures on a circumference thereof, at locations in or on said upper horizontal wells which are directly above points of traverse where said upper horizontal wells traverse and pass over said lower production wells, to thereby block such apertures at such locations and thereby block a direct route of travel by the injected fluid from the upper injection wells directly downwards into the lower production well at such point(s) of traverse.

* * * * *